US007650654B2

(12) United States Patent
Lambarth et al.

(10) Patent No.: US 7,650,654 B2
(45) Date of Patent: Jan. 26, 2010

(54) TRANSFER DEVICE

(75) Inventors: Cliff Lambarth, Portage, MI (US); Jeff Lewandowski, Delton, MI (US); Martin Stryker, Kalamazoo, MI (US); Jason Kneen, Portage, MI (US)

(73) Assignee: Stryker Corporation, Kalamazoo, MI (US)

( * ) Notice: Subject to any disclaimer, the term of this patent is extended or adjusted under 35 U.S.C. 154(b) by 25 days.

(21) Appl. No.: 11/714,039

(22) Filed: Mar. 5, 2007

(65) Prior Publication Data

US 2008/0216231 A1 Sep. 11, 2008

(51) Int. Cl.
*A61G 1/003* (2006.01)

(52) U.S. Cl. ..... 5/81.1 HS; 5/81.1 T; 5/81.1 R; 5/81.1 C

(58) Field of Classification Search ..... 5/81.1 T, 5/81.1 C, 81.1 HS, 81.1 R
See application file for complete search history.

(56) References Cited

U.S. PATENT DOCUMENTS

| | | | | |
|---|---|---|---|---|
| 2,706,821 | A * | 4/1955 | Griggs | 5/723 |
| 2,827,642 | A | 3/1958 | Huff | |
| 3,769,642 | A * | 11/1973 | Warman | 5/81.1 T |
| 3,829,914 | A | 8/1974 | Treat | |
| 3,948,344 | A | 4/1976 | Johnson et al. | |
| 4,272,856 | A * | 6/1981 | Wegener et al. | 5/81.1 T |
| 5,005,232 | A | 4/1991 | Wright et al. | |
| 5,280,657 | A | 1/1994 | Stagg | |
| RE35,299 | E | 7/1996 | Weedling et al. | |
| 5,966,754 | A * | 10/1999 | Schuster | 5/81.1 R |
| 6,012,183 | A | 1/2000 | Brooke et al. | |
| 6,374,435 | B1 * | 4/2002 | Leininger et al. | 5/81.1 HS |
| 6,675,411 | B1 | 1/2004 | Javier | |
| 6,820,292 | B2 | 11/2004 | Heimbrock | |
| 7,020,912 | B2 | 4/2006 | Berge | |
| 2002/0138911 | A1 * | 10/2002 | Giori et al. | 5/709 |
| 2005/0102750 | A1 * | 5/2005 | Berge | 5/81.1 HS |

OTHER PUBLICATIONS

PCT International Search Report for PCT Application No. PCT/US07/11815 mailed Sep. 15, 2008.
PCT Written Opinion or the International Search Authority for PCT Application No. PCT/US07/11815 mailed Sep. 15, 2008.

* cited by examiner

*Primary Examiner*—Peter M. Cuomo
*Assistant Examiner*—William Kelleher
(74) *Attorney, Agent, or Firm*—Van Dyke, Gardner, Linn & Burkhart, LLP

(57) ABSTRACT

A transfer device includes a first sheet portion having an outer side and an inner side and a second sheet portion having an outer side and an inner side, with the inner sides arranged so that they are facing each other. The outer sides each have a high coefficient of friction surface. The first sheet portion and the second sheet portion are releasably coupled together to thereby limit relative movement of the first sheet portion to the second sheet portion. When the coupling is released, the first sheet portion and the second sheet portion can move relative to each other.

40 Claims, 10 Drawing Sheets

TRANSFER DEVICE

TECHNICAL FIELD AND BACKGROUND OF THE INVENTION

The present invention generally relates to a transfer device for moving an object or a person, such as a patient, and, more specifically, to a transfer device that is particularly suitable for moving a patient, including transferring a patient from one surface to another surface, which may reduce strain or stress on the attendant who is charged with moving the patient.

When a patient is delivered to a healthcare facility on a stretcher, for example, the patient is typically transferred from the stretcher to another support surface, such as a surgical table or emergency room bed for treatment. Further, following treatment, the patient then must be transferred from the surgical table or bed to a stretcher, which then transports the patient to a hospital room or ICU where the patient is then again transferred back onto a bed. A patient can go through a number of transfers during his or her stay at a healthcare facility, all of which are typically done manually.

When dealing with a heavy patient or a patient who is non-ambulatory, the manipulation of the person may be difficult. With an obese patient, the transfer can be quite difficult even with two attendants and may have the potential to cause back stress or strain to the attendant or attendants. Non-ambulatory patients, including unconscious patients, especially patients suffering from a back or neck injury, must be handled with particular care and in a manner that will not adversely effect or worsen the patient's condition. Further, patients that are unconscious or too frail to move themselves may simply need to be repositioned on a surface, such as a bed. An unconscious patient or a frail patient may have a tendency to slide down a bed due to the angle of the bed, which is typically tilted to some degree to avoid fluid build up in the patient's lungs.

Current solutions for moving a patient include placing a device that has a low coefficient of friction, such as sheet or board, under the patient and then moving the patient on the device, for example to the next surface, and then removing the device. However, on heavy patients this may cause tissue trauma or injury. More recently, inflatable air pallets have been used. One problem faced with any of these devices is locating the device under the patient. The other concern is that the device may cause safety concerns in that it may allow the patient to move when the patient is not intended to be moved.

Accordingly, there is a need for a transfer device that will facilitate movement of a patient when a transfer or repositioning is desired, which can reduce stress and strain on the back of the attendants who move the patient, but will minimize or reduce the likelihood of unintended movement of the patient when no transfer or repositioning of the patient is desired.

SUMMARY OF THE INVENTION

Accordingly, the present invention provides a device that allows an object or person, such as a patient, to be easily moved when movement is desired, but which reduces, if not eliminates the unwanted movement of the object or person when no transfer is desired.

In one form of the invention, a transfer device includes a first sheet portion having an outer side and an inner side and a second sheet portion having an outer side and an inner side, with the inner sides arranged so that they are facing each other. The first sheet portion is releasably coupled to the second sheet portion, either directly or indirectly, wherein the coupling limits translational movement, such as lateral, longitudinal, or rotational movement, of the first sheet portion relative to the second sheet portion, and wherein when the coupling is released the first sheet portion may move or translate with respect to the second sheet portion.

In one aspect, the transfer device further includes a closed chamber formed between the first sheet portion and the second sheet portion. The chamber includes a medium, which is either added to or removed from the chamber, to generate a force, such as a friction, that couples the first and second sheet portions together, again either directly or indirectly. For example, the medium may comprise a vacuum pressure formed in the chamber wherein the inner sides of the first sheet portion and the second sheet portion are frictionally coupled together, directly or indirectly through an intermediate member, to thereby limit relative movement of the first sheet portion to the second sheet portion. When the medium, such as the vacuum pressure, is removed the first sheet portion and the second sheet portion are then decoupled and the first sheet portion and the second sheet portion can translate or move relative to each other.

Examples of other suitable media include: charges generated between the two sheet portions to couple the two sheet portions, either directly or indirectly, or chemical bonding, such as adhesive bonding, which is then released by the addition of another medium, such as releasing medium, including for example oxygen.

Alternately, the first sheet portion and the second sheet portion may be mechanically coupled together, for example by stitching, to thereby limit relative movement of the first sheet portion to the second sheet portion.

In other aspects, each of the outer sides has a high coefficient of friction, while at least one of the inner sides has a low coefficient of friction surface.

In another aspect, the transfer device is formed from a sheet, which is folded over to form the first sheet portion and the second sheet portion. For example, the sheet maybe folded and joined at its ends to form a closed loop and, further, may include a half-twist, such as in a Möobius (Moebius) strip.

According to yet another aspect, the low coefficient of friction surface is formed by a silicone (or other lubricious polymer such as Teflon, UHMWPE, etc.)surface or coating that may be applied, for example, by spraying.

In further aspects, each of the outer surfaces of the first sheet portion and the second sheet portion includes a rubberized surface or similar flexible high friction surface to thereby form the high coefficient of friction surfaces. The surface may be substantially continuous or may be formed from discrete areas, such as patches or regions of high friction material, or from a mesh fabric. For example, a rubber-based coating or rubber-based structures or a rubber-based fabric may be applied to the outer surfaces, for example, by spraying, molding, or gluing. Alternately or in addition, surface variations may be provided at or formed in the outer sides to form the high coefficient of friction surfaces. Such surface variations may include ribs, bumps, conical or prismatic structures or may simply be formed from a roughened or textured surface.

In yet another aspect, the transfer device includes a vacuum release device for releasing the vacuum pressure. For example, the vacuum release device may comprise a tab or pull strip or chord or the like, which when pulled creates an aperture or hole in one of the sheet portions. Alternately, the vacuum release device may comprise a valve, such as a resealable valve so that the transfer device may be reused.

In another form of the invention, a transfer device includes a closed loop of flexible material having an upper portion and a lower portion, each with an outer surface and an inner surface. The outer surfaces comprise high coefficient of friction surfaces, while at least one of the inner surfaces comprises a low coefficient of friction surface. The ends of the closed loop are sealed to thereby form a closed chamber. The closed chamber is sealed to hold a vacuum pressure but is adapted to allow the vacuum pressure to be selectively released. When a vacuum pressure is formed in the chamber, the vacuum pressure generates a normal force between the upper and lower portion of the loop such that the inner surfaces of the upper portion and lower portion are frictionally coupled together, either directly or through an intermediate member, to thereby limit relative lateral movement of the upper portion of the loop relative to the lower portion of the loop. When the vacuum pressure is released the inner surfaces can translate relative to each other or relative to an intermediate member. In this manner, the upper portion and the lower portion can translate relative to each other.

In one aspect, one of the inner surfaces includes a silicone surface or other lubricious polymer to thereby form the low coefficient of friction surface.

In yet other aspects, each of the outer surfaces comprises a rubber-based or rubber-like surface to thereby form the high coefficient of friction surfaces.

In a further aspect, the transfer device includes a vacuum release device for releasing the vacuum pressure.

According to another form of the invention, a transfer system includes first and second transfer devices coupled together, with each of the transfer devices including upper and lower sheet portions. Each of the upper and lower sheet portions are releasably coupled together to limit relative lateral movement of the upper and lower sheet portions.

Accordingly, the present invention provides a transfer device that facilitates transfer of an object or person, such as a patient, when a transfer or movement is desired but reduces the likelihood of an unwanted shifting of the object or patient when no transfer or movement is desired.

These and other objects, advantages, purposes, and features of the invention will become more apparent from the study of the following description taken in conjunction with the drawings.

DESCRIPTION OF THE PREFERRED EMBODIMENTS

Figure 1:
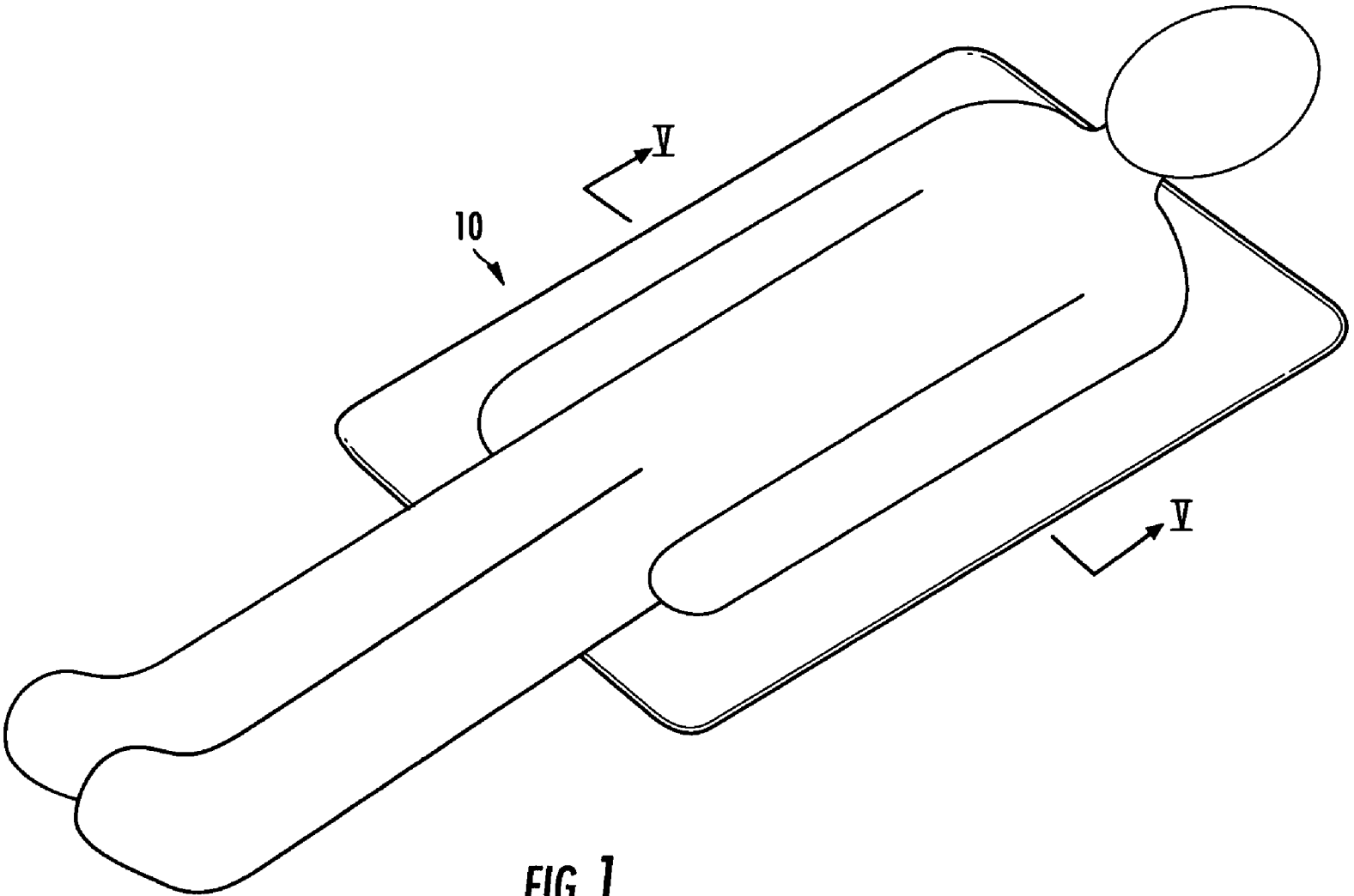
FIG. 1 is a perspective view of a transfer device of the present invention.

Referring to FIG. 1, the numeral 10 generally designates a transfer device of the present invention. As will be more fully described below, transfer device 10 is configured to facilitate movement of an object or patient when movement is desired but to limit or minimize movement of the object or patient when no movement of the object or patient is desired. Further, the transfer device is typically placed on a support surface prior to the object or patient, which is configured to limit the amount of movement of the object or person until movement or a transfer of the object or patient is desired. When a transfer or movement of the object or patient is desired, the transfer device then allows the object or patient to be moved or transferred. While not intending to be limiting in anyway, for ease of description, the following description of the transfer device will be made in reference to its use for moving or transferring patients, though it should be understood that transfer device 10 may be used to move a variety of objects, as noted, such as equipment, pallets, mattresses, or any other objects.

Figure 2:
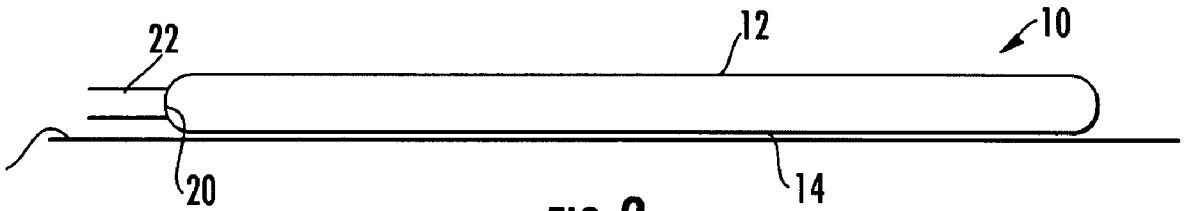
FIG. 2 is a side view of the transfer device of FIG. 1 illustrating when the upper sheet portion and lower sheet portion of the device are decoupled.
Figure 3:
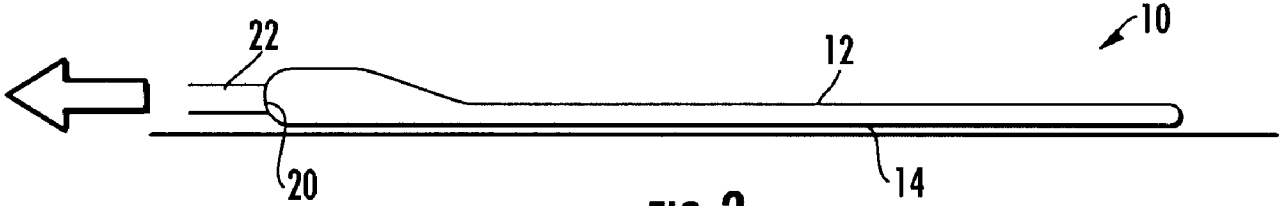
FIG. 3 is a similar view to FIG. 2 illustrating a fluid being drawn from the chamber of the transfer device to generate a vacuum pressure in the chamber of the transfer device.
Figure 4:
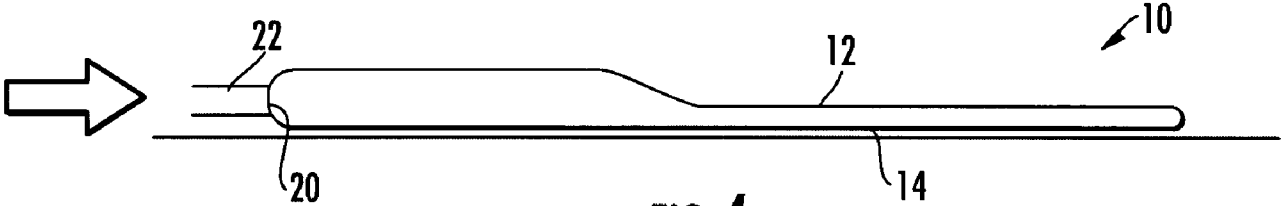
FIG. 4 is a similar view to FIG. 3 illustrating the introduction of a fluid into the transfer device to release the vacuum pressure.

Referring to FIGS. 2-4, transfer device 10 includes an upper sheet portion 12 and a lower sheet portion 14. It should be understood that the term "sheet" is used herein in its broadest sense and includes, for example, a broad, thin piece of material, including rigid, semi-rigid, or flexible material. Further, the term "sheet" includes pieces of material with varying thicknesses, including very thin flexible sheets, such as membranes. In addition, the term "sheet portion" is used to refer to just a portion or section of a sheet.

Figure 15:
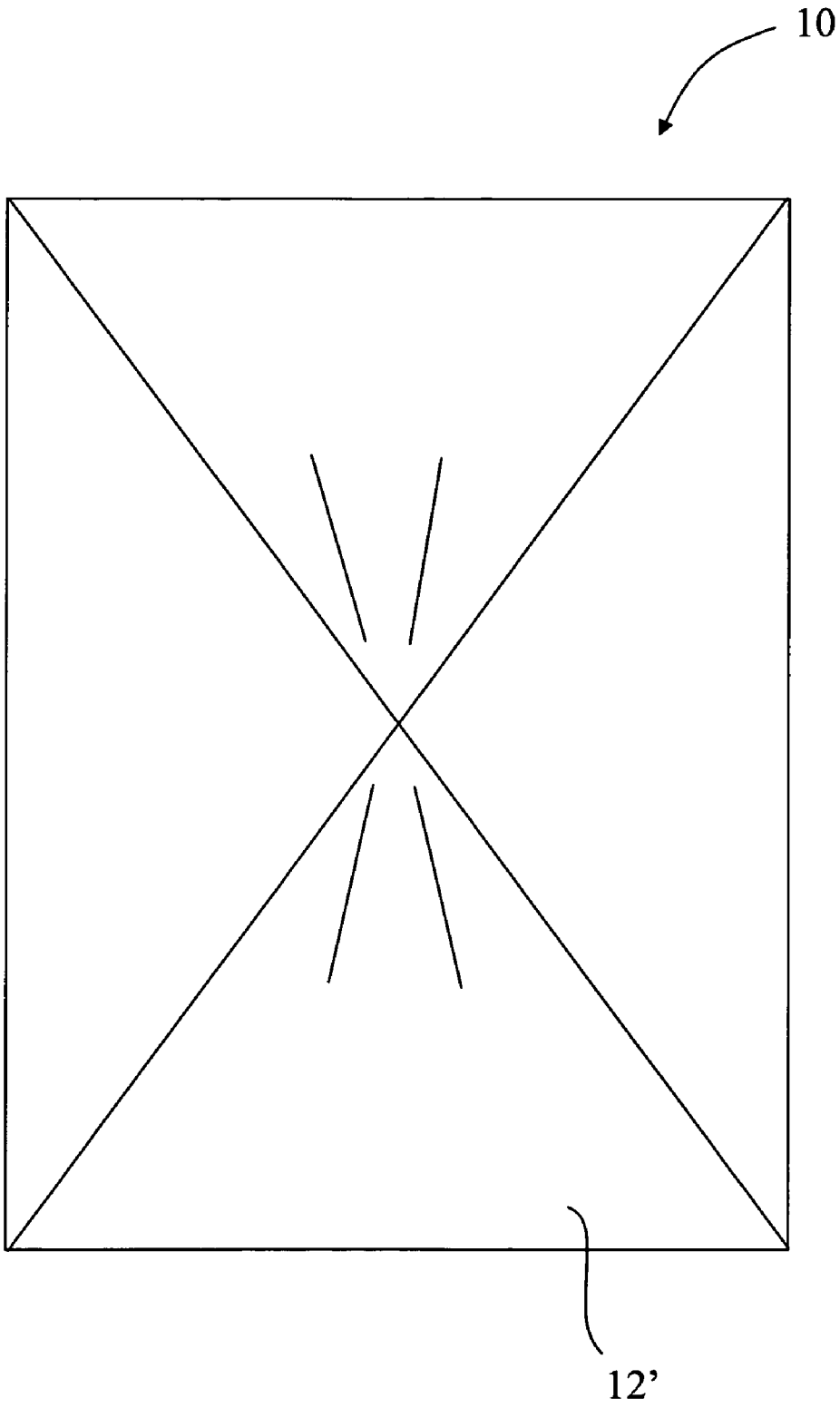
FIG. 15 is a plan view of another embodiment of the patient transfer device formed from a möbius strip.

In the illustrated embodiment, upper sheet portion 12 and lower sheet portion 14 are formed from a thin flexible sheet material, such as plastic. Sheet portions 12 and 14 may be formed from a single sheet of thin flexible material or from more than one sheet of thin flexible material, which are then secured together by seams, formed for example by welding, bonding, stitching, or the like. Further, while illustrated as being formed from a loop of material, in which the ends of the sheet are joined together, the upper and lower sheet portions may be provided by a Möbius (Moebius) strip 12' (FIG. 15) by joining the ends of a sheet of material with a half-twist.

As will be more fully described below, the upper sheet portion 12 and lower sheet portion 14 are releasably coupled together, either directly or indirectly through an intermediate member, such as an insert, including another sheet portion. Further, a medium is introduced between the upper sheet portion and the lower sheet portion to provide this coupling and then removed to release the coupling. The term "medium" is used in its broadest sense and includes, for example, any substance or environment that will releasably couple the two sheet portions together. While the present application provides several examples of suitable media, including a vacuum pressure environment, an electrostatic environment, a chemical, such as an adhesive, or mechanical couplers, such as stitches, it should be understood that other media may be used.

Figure 5:
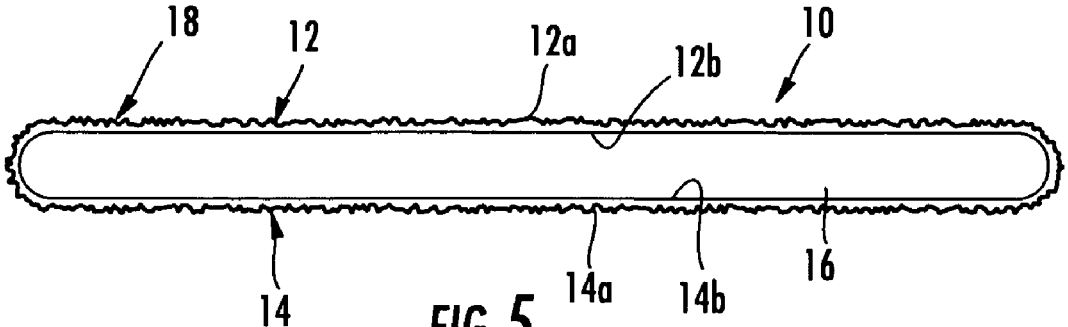
FIG. 5 is a cross-section taken along line V-V of FIG. 1 schematically illustrating the outer surface of the transfer device having a high friction surface.
Figure 6:
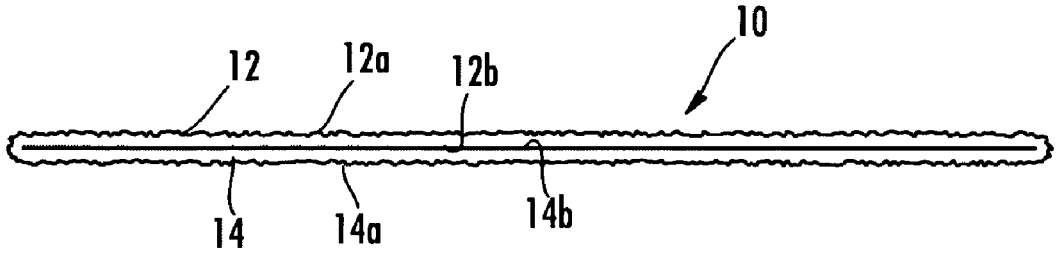
FIG. 6 is a similar view to FIG. 5 illustrating the inner surfaces of the upper sheet portion and of the lower sheet portion of the device directly coupled together.
Figure 7:
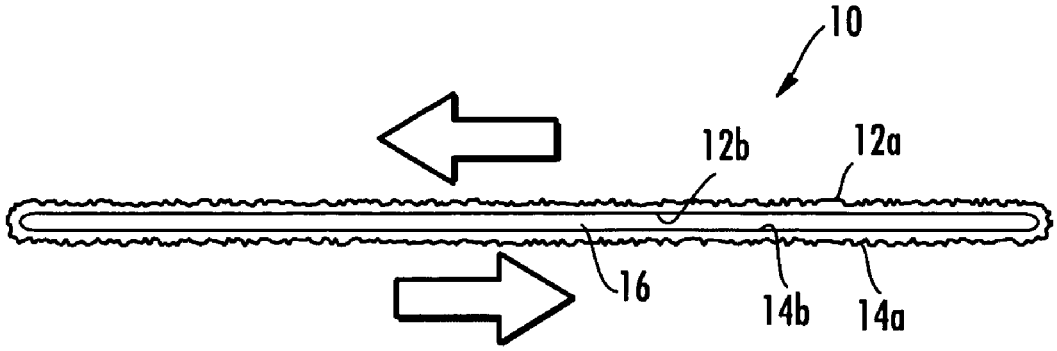
FIG. 7 is a similar view to FIG. 6 illustrating the inner surfaces of the upper sheet portion and of the lower sheet portion of the device decoupled.

As best seen in FIGS. 5-7, upper sheet portion 12 includes an outer side 12*a* and an inner side 12*b*. Similarly, lower sheet portion 14 includes an outer side 14*a* and an inner side 14*b*, with the inner sides 12*b*, 14*b* of the sheet portions arranged to face each other. Optionally, at least one of the inner sides 12*b*, 14*b* has a surface with a low coefficient of friction so that the upper sheet portion 12 can slide relative to lower sheet portion 14. Further, both inner sides 12*b* and 14*b* may have surfaces with a low coefficient of friction. Alternately, as will be more fully described below, the low friction surface may be provided on an intermediate member positioned between the upper and lower sheet portions.

In contrast, outer sides 12*a* and 14*a*, each have an outer surface that is "stickier" or has a higher coefficient of friction than the low friction inner surface (e.g. side 12*b* or 14*b* or the intermediate member) so that when loaded with a person the lower sheet portion will generally not slide relative to the support surface S on which transfer device 10 is supported; instead, the upper sheet portion 12 will translate relative to lower sheet portion 14 due to the low coefficient of friction between the upper and lower sheet portions to create a shifting or rolling movement (or a combination thereof) either to the left or to the right as viewed in FIG. 7 depending on which way a force is applied to the upper sheet portion.

Alternately, the upper sheet portion 12 may translate relative to lower sheet portion 14 in a longitudinal direction, which may be helpful, for example, when moving a patient up or down a bed. Further, the upper sheet portion may rotate relative to the lower sheet portion. This rotational movement may facilitate rotation of a patient on surface, such as bed to help the person leave the bed, which may be particularly suitable for heavy patients.

In addition, upper sheet portion 12 and lower sheet portion 14 are adapted to be releasably coupled together to limit relative translational (lateral, longitudinal, or rotational) movement of the upper sheet portion relative to the lower sheet portion. Further, as noted, the outer sides or surfaces of the sheet portions have a higher coefficient of friction or are "sticky" relative to low friction surface(s) provided between the upper and lower sheet portions so that when the two sheet portions are directly coupled together, or indirectly coupled through an intermediate member noted below, the transfer device does not provide a readily available transfer surface. However, once the coupling of the upper and lower sheet portions is released the inner sides may slide relative to each other (or to the intermediate member) and the upper sheet portion may move or translate relative to the lower sheet portion such that the transfer device provides a transfer surface.

Figure 12:
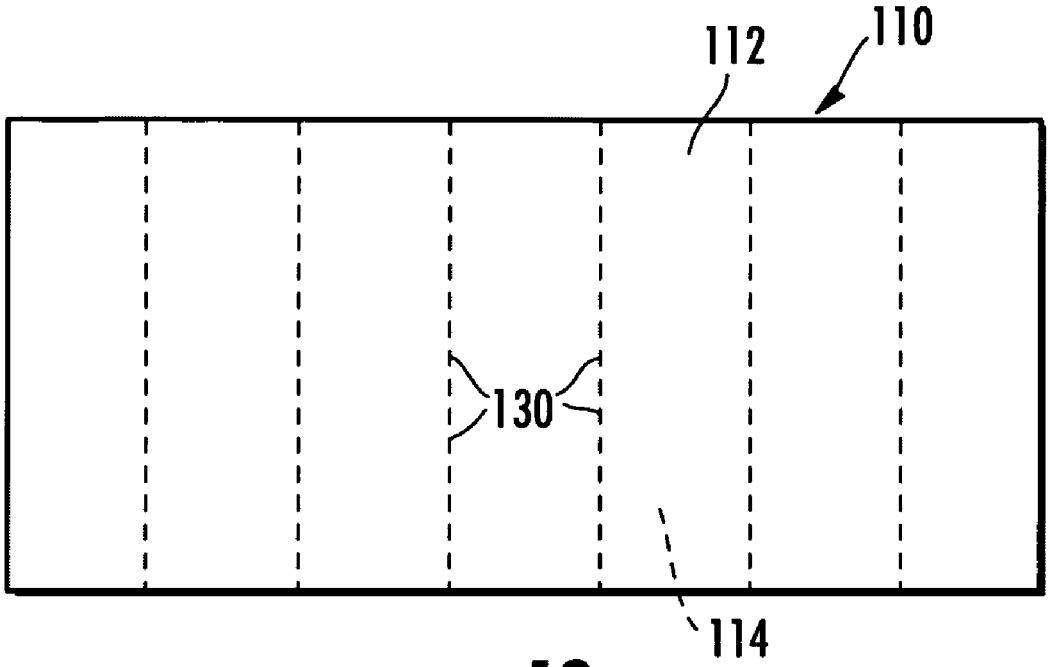
FIG. 12 is a plan view of another embodiment of the transfer device incorporating mechanical coupling of the upper and lower sheet portions.
Figure 13:
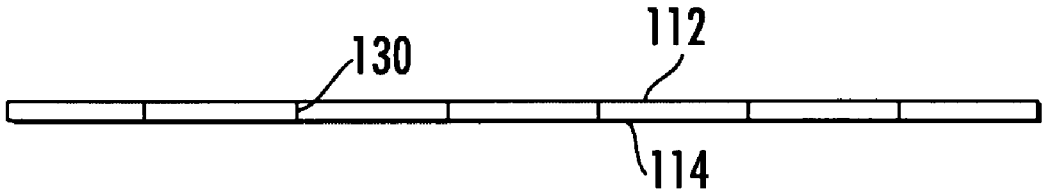
FIG. 13 a cross-section of the transfer device of FIG. 12.

In the illustrated embodiment shown in FIGS. 5-7, the inner side of the upper sheet portion and the inner side of the lower sheet portion are selectively directly frictionally coupled together by a releasable compressive force created, for example, by a vacuum pressure formed or generated in a closed chamber 16, which is formed between the sheet portions between the inner sides. Alternately, the inner side of the upper sheet portion and the inner side of the lower sheet portion are selectively coupled together by a mechanical attachment, such as stitching or the like, described more fully in reference to FIGS. 12 and 13.

When the coupling is generated by a vacuum pressure, the vacuum pressure may be created when forming device 10. For example a vacuum may be drawn when the edges of the sheet are sealed, such as by press molding, bonding, or by heat welding/sealing. In this case the vacuum may be released by creating a vacuum releasing device, such as a hole or aperture, in one of the sheet portions. This can be done by simply puncturing the transfer device or by vacuum releasing device that is formed or provided in the transfer device when the transfer device is formed. For example, as best in FIG. 8, one of the sheet portions may include a tab or pull chord or strip 24, which when pulled tears and forms an opening in the sheet portion to thereby allow fluid into chamber 16.

Alternately, the vacuum pressure may be generated after forming the device through a re-sealable opening or aperture 20 provided in one of the sheet portions 12 or 14. In this manner, fluid is forced out of the chamber by applying suction through the opening to thereby evacuate fluid, such as air, from chamber 16. After generating the vacuum pressure, the opening is then sealed. When a transfer is desired, the opening is then reopened. For example, opening 20 may be provided with a valve 22 to releasably seal the opening and, further, so that the transfer device may be used more than once. It should be understood that in all applications, including disposable applications, a valve is optional.

The low coefficient of friction surface(s) may be formed by a lubricious polymer coating, such as a silicone coating, which may be applied to one or more of the inner side(s) of the respective upper and lower sheet portions, for example, by spraying or dipping or other coating methods. The low coefficient of friction surface(s) may be provided by other mediums, including water, oil or silica to name a few, which will be held between the sheets by the vacuum.

The high coefficient of friction surfaces may be formed from a rubber-based coating, surface or material or from surface structures formed at or in the outer sides of the respective sheet portions. For example, a suitable high friction surface may be applied by spraying or may be adhesively applied in the form of another sheet or layer. The surface structures may be formed by molding, including press molding, or may be formed from masking the surface and then spraying a high friction coating onto the outer surface.

Alternately, the sheets or sheet forming device 10 may be formed from a material that has a high friction surface, such as SARAN™ wrap, polyethylene or anti-static or static dissipative materials (ESD-type materials).

SARAN™ wrap, namely saran polyvinylidene chloride or Saran resins and films (PVDC), would provide a "sticky" or high friction outer surface with its inner sides then treated with a coating, as noted above, to form the lower coefficient of friction surface or surfaces at the inner sides.

Polyethenes (PE) are classified into several different categories based mostly on its density and branching. The mechanical properties of PE depend significantly on variables such as the extent and type of branching, the crystal structure, and the molecular weight. Examples of suitable polyethylenes include: UHMWPE (ultra high molecular weight PE); HMWPE (high molecular weight polyethylene); HDPE (high density PE); HDXLPE (high density cross-linked PE); PEX (cross-linked PE); MDPE (medium density PE); LDPE (low density PE); LLDPE (linear low density PE);

VLDPE (very low density PE); or UHMWPE (ultrahigh molecular weight polyethylene).

For example, UHMWPE has a molecular weight numbering in the millions, usually between 3.1 and 5.67 million. The high molecular weight results in less efficient packing of the chains into the crystal structure as evidenced by densities less than high density polyethylene (e.g. 0.935-0.930 g/cc). The high molecular weight results in a very tough material. UHMWPE can be made through any catalyst technology, although Ziegler catalysts are most common.

HDPE is defined by a density of greater than or equal to 0.941 g/cc. HDPE has a low degree of branching and thus stronger intermolecular forces and tensile strength. HDPE can be produced by chromium/silica catalysts, Ziegler-Natta catalysts or metallocene catalysts.

The lack of branching is ensured by an appropriate choice of catalyst (e.g. Chromium catalysts or Ziegler-Natta catalysts) and reaction conditions.

PEX is a medium- to high-density polyethylene containing cross-link bonds introduced into the polymer structure, changing the thermoplastic into an elastomer. The high-temperature properties of the polymer are improved, its flow is reduced and its chemical resistance is enhanced.

MDPE is defined by a density range of 0.926-0.940 g/cc. MDPE can be produced by chromium/silica catalysts, Ziegler-Natta catalysts or metallocene catalysts. MDPE has good shock and drop resistance properties. It also is less notch sensitive than HDPE, stress cracking resistance is better than HDPE.

LLDPE is defined by a density range of 0.915-0.925 g/cc. is a substantially linear polymer, with significant numbers of short branches, commonly made by copolymerization of ethylene with short-chain alpha-olefins (e.g. 1-butene, 1-hexene, and 1-octene). LLDPE has higher tensile strength than LDPE. Exhibits higher impact and puncture resistance than LDPE.

LDPE is defined by a density range of 0.910-0.940 g/cc. LDPE has a high degree of short and long chain branching, which means that the chains do not pack into the crystal structure as well. It has therefore less strong intermolecular forces as the instantaneous-dipole induced-dipole attraction is less. This results in a lower tensile strength and increased ductility. LDPE is created by free radical polymerization. The high degree of branches with long chains gives molten LDPE unique and desirable flow properties.

VLDPE is defined by a density range of 0.880-0.915 g/cc. is a substantially linear polymer, with high levels of short chain branches, commonly made by copolymerization of ethylene with short-chain alpha-olefins (e.g. 1-butene, 1-hexene, and 1-octene). VLDPE is most commonly produced using metallocene catalysts due to the greater co-monomer incorporation exhibited by these catalysts.

Suitable anti-static materials (where initial charges are suppressed ) or static dissipative materials (where there are no or low initial charges) (ESD-type materials) may also be used as the sheet, which would prevent discharge to or from human contact and are commercially available under the trademarks HYDEL® or TECAFORM®. The ESD-type materials may also be used for the interior or inner surface so that static charges do not build up, causing excessive "frictional coupling" or static cling.

Figure 9:
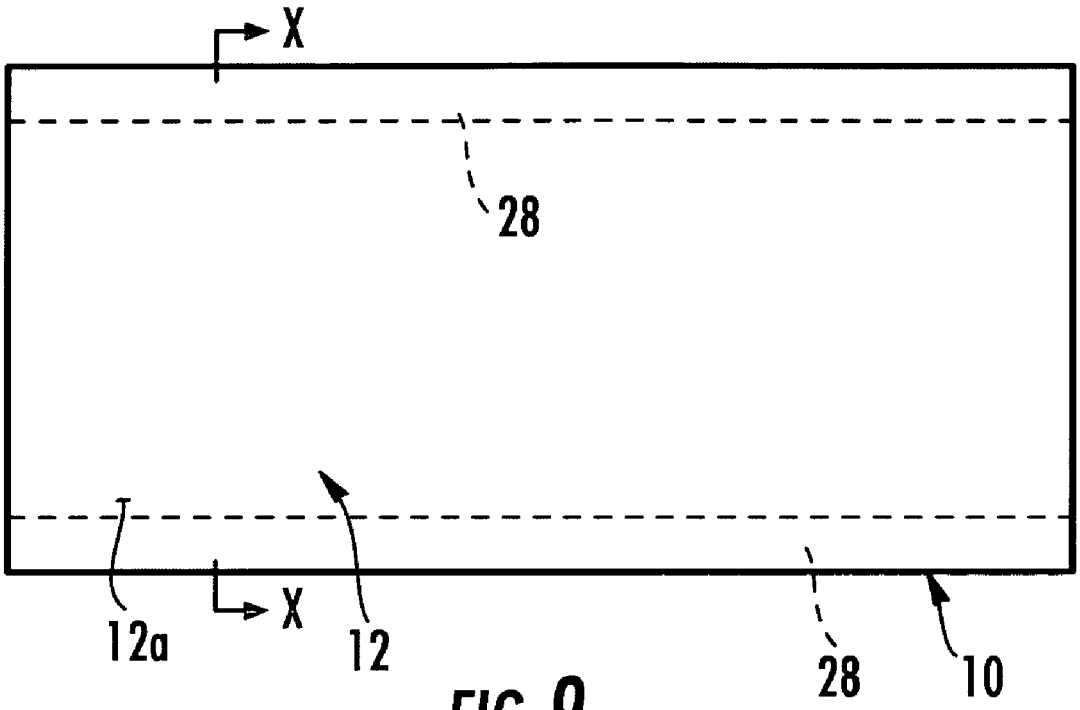
FIG. 9 is a plan view of another embodiment of the transfer device incorporating gussets in the sides of the device.
Figure 10:
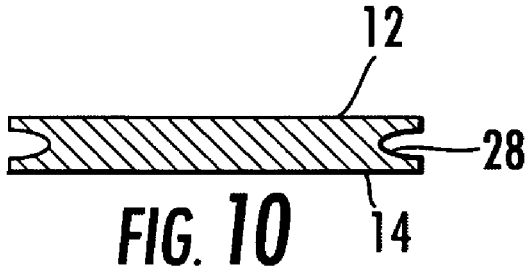
FIG. 10 is a cross-section taken along line X-X of FIG. 9.

As noted above, upper sheet portion 12 and lower sheet portion 14 may be formed from a single sheet of flexible material that is folded over and then joined at its longitudinal edges to form a closed loop 18 of material and, further, joined at its opposed ends to form closed chamber 16. Alternately, as noted, the upper sheet portion 12 and lower sheet portion 14 may be formed by a Möbius strip. Further, device 10 may incorporate side portions or gussets that can be created when forming device. As best seen in FIGS. 9 and 10, gussets 28 may be formed at the longitudinal or longer sides of transfer device. When in the coupled state where the upper sheet portion and lower sheet portion are coupled by the vacuum, gussets 28 may be folded in between the upper sheet portion and the lower sheet portion, as best seen in FIG. 10. When a transfer or movement is desired and the coupling is released, the gussets will increase the range of motion of the upper sheet portion relative to the lower sheet portion. Once the gussets are fully extended, further shifting of the upper sheet portion will induce a rolling effect. As would be understood the larger the gussets, the greater the range of motion of the upper sheet portion relative to the lower sheet portion before the device starts to roll. Though illustrated along the longitudinal or long sides of the transfer device, it should be understood that these gussets may be formed at the opposed ends of the transfer device, which may be suitable when the transfer device is configured for moving a patient up or down a surface, such as bed. Additionally, gussets 28 may be provided along the sides and ends of the transfer device. This configuration may be particularly suitable when a rotational movement is desired. Alternately, or in addition, gussets may be provided that are angled or arranged along a diagonal of the transfer device, which may be provided to provide some directional control over the movement of the top or upper sheet relative to the lower sheet.

In preferred form, as noted above, sheet portions 12 and 14 are formed from a flexible material, such as plastic, including a heat sealable plastic. As noted above, suitable plastics may include polyethylenes, such as: UHMWPE (ultra high molecular weight PE); HMWPE (high molecular weight polyethylene); HDPE (high density PE); HDXLPE (high density cross-linked PE); PEX (cross-linked PE); MDPE (medium density PE); LDPE (low density PE); LLDPE (linear low density PE); VLDPE (very low density PE); or UHMWPE (ultrahigh molecular weight polyethylene). Furthermore, the material forming the sheet portions may have a tint or color pigment or may be clear or opaque. For example, the transfer devices may be color-coded depending on their application.

While the foregoing description describes loop 18 as being formed from a single sheet of material, which forms the upper and lower sheet portions 12 and 14, it should be understood that multiple sheets (two or more sheets) may be used to form loop 18.

Figure 11:
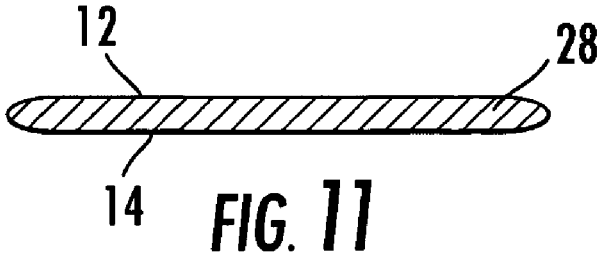
FIG. 11 is a side elevation view of the transfer device of FIG. 9 illustrating the upper sheet portion decoupled from the lower sheet portion.
Figure 11A:
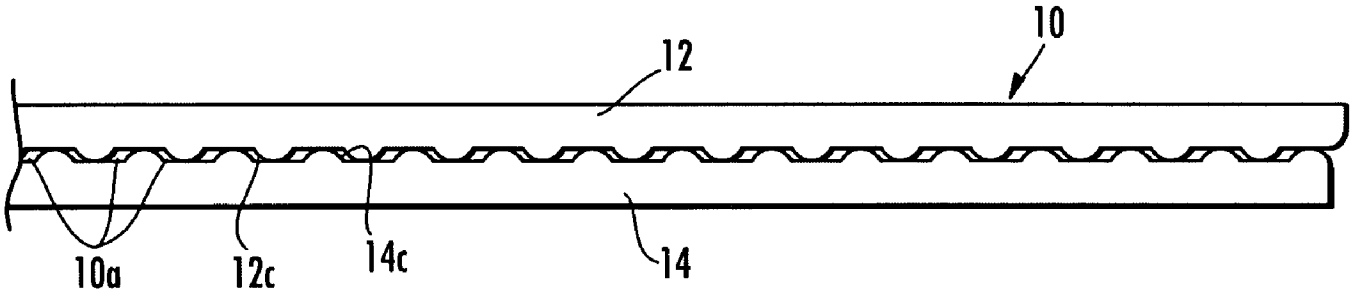
FIG. 11A is a side view of the transfer device illustrating channels extending through the device.
Figure 11B:
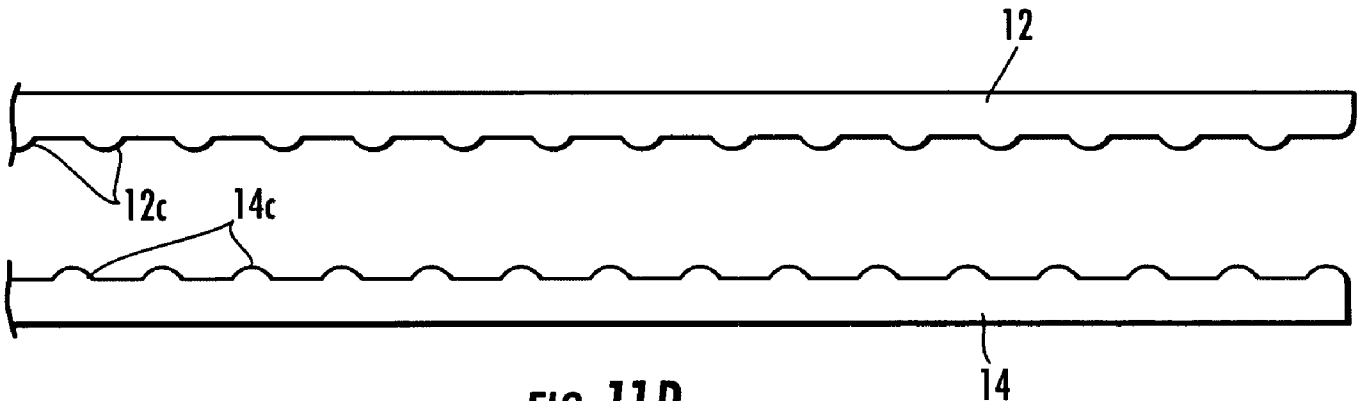
FIG. 11B is an exploded view of FIG. 11A.
Figure 11C:
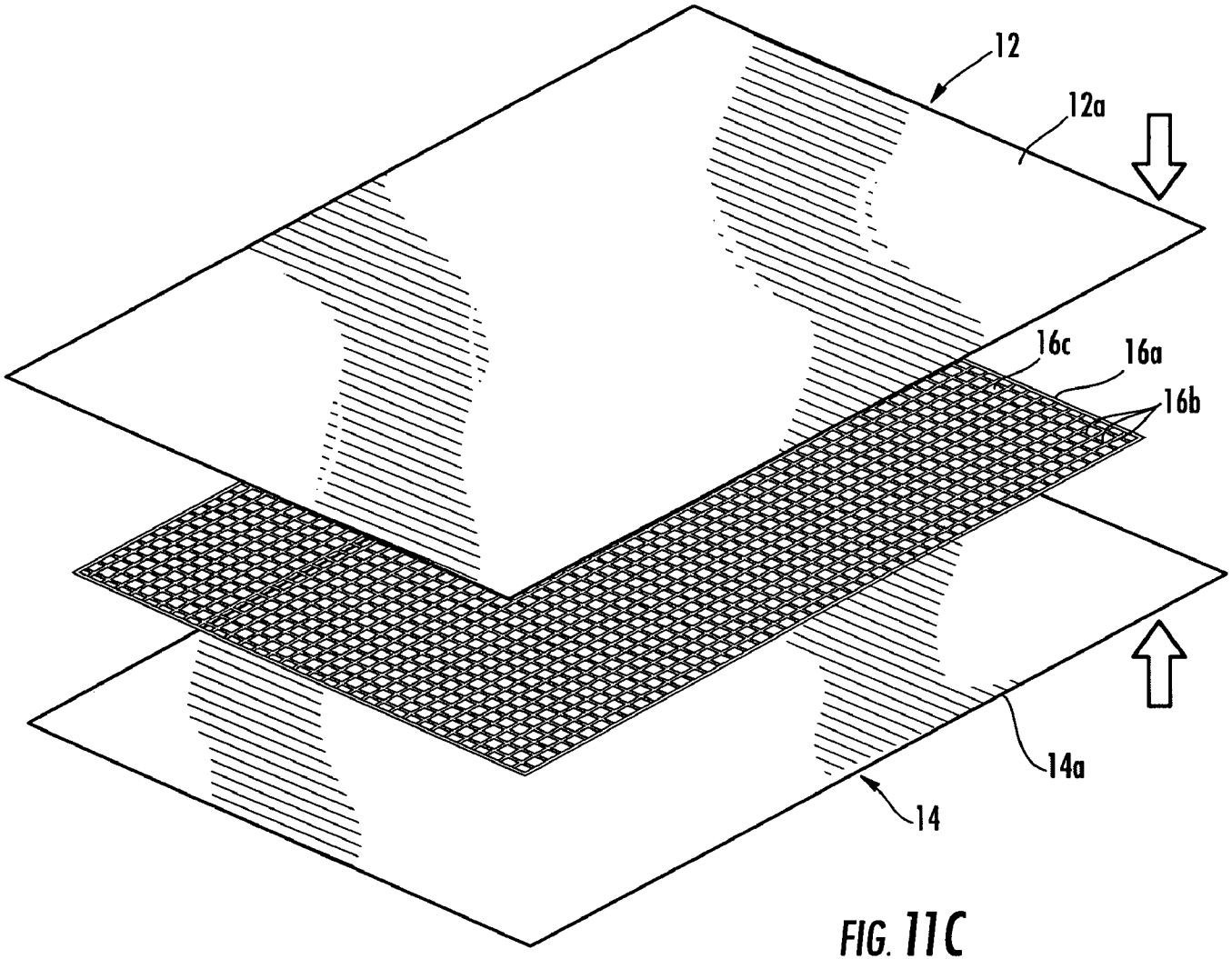
FIG. 11C is an exploded perspective view of the transfer device of the present invention incorporating an intermediate member.

In order to assure that the vacuum pressure extends through the chamber and is not just created at the local area where the suction is applied, device 10 optionally includes a plurality of channels or passageways 10*a* that extend into chamber 16 and preferably across chamber 16. The channels or passageways 10*a* may be formed by ridges 12*c*, 14*c* provided on or at one of the inner sides 12*b*, 14*b* (FIGS. 11A and 11B) or may be provided by an intermediate member or insert 16*a* (shown in phantom in FIG. 1A), such as another sheet portion inserted into the chamber. For example, the insert may comprise another sheet portion that includes a plurality of ridges or recesses or passageways, which allow the vacuum pressure to extend into the chamber and preferably throughout the chamber. In the illustrated embodiment, intermediate member 16*a* comprises a lattice-type sheet with a plurality of interconnecting webs 16*b* that form a non-planar surface and which creates passageways 16*c* between the sheets 12 and 14. Further, as noted above, the intermediate member may comprise a low friction material or have a low friction surface on at least one side to provide the low friction surface between the upper and lower sheet portions.

As would be understood in operation, when device 10 is first located on a support surface, chamber 16 has a vacuum pressure. As noted, this vacuum pressure may be generated either during the forming process of device 10 or may be generated by exhausting fluid, typically air, from the chamber 16. When the vacuum pressure is generated, the inner sides 12*b* and 14*b* of the respective sheet portions are effectively directly coupled together, or indirectly through the intermediate member, to thereby limit movement of the upper sheet portion relative to the lower sheet portion even if a lateral force is applied to the top surface of the transfer device. At this point it is safe to place a patient on the transfer device. However, when a transfer is desired, the vacuum pressure may be released, by forming a hole or opening in one of the sheet portions (for example, by pulling on tab 24) or by opening valve 22 so that the inner sides 12*b* and 14*b* of upper and lower sheet portions 12 and 14 are no longer frictionally coupled and, instead, are released to permit translation of the upper sheet portion 12 relative to the lower sheet portion 14. This translation may be lateral, longitudinal or rotational and occurs when a lateral force is applied to the upper sheet portion, either directly in the form of a tension force, or indirectly by a sheer force generate by a slide sheet, which can be used in conjunction with the transfer device. Typically, the upper sheet portion moves in a plane that is generally parallel to the support surface and parallel to the plane in which at least a portion of the lower sheet portion occupies at least while just relative shifting of the two sheet portions occurs. Once further shifting occurs, the device may roll, as noted above.

Optionally, air may be pumped into the chamber to release the vacuum pressure and, further, optionally provide a pressure greater than atmospheric pressure, which may be used to inflate the chamber. For example, a $CO_2$ cartridge may be provided and optionally coupled to the device, which can supply $CO_2$ to chamber 16.

Once the transfer has been achieved, the device may be removed from under the patient or may be depressurized again to limit the lateral motion of the upper sheet portion relative to the lower sheet portion. As noted above, transfer device 10 may be configured to allow the opening to be resealed and a vacuum reapplied for its next use when the patient needs to be transferred again.

When a disposable transfer device is desired and, further, where only a single transfer is expected with the device, the vacuum may be released by simply puncturing the transfer device or by a pull device such as a tab or string, as described above, which may be integrally formed with one of the sheet portions. This pull device may take many forms.

In addition, to facilitate a transfer, transfer device 10 may incorporate one or more handles, which may be integrally formed with either one or both of the sheet portions or formed by straps, which are secured to the transfer device. Optionally, the vacuum release device may be located near or adjacent the respective handle(s) so when a caregiver releases the vacuum pressure, the caregiver can immediately grab hold of the handle(s) to control the transfer of the patient.

As noted above and shown in FIGS. 12 and 13, the present invention also includes a transfer device 110 with upper and lower sheet portions 112 and 114 that are releasably coupled together by mechanical coupling or a charge or static coupling. For example, upper and lower sheet portions 112 and 114 may be coupled to together by a plurality of stitches 130, which when broken and pulled out release the sheet portions. Stitches 130 may be formed at spaced locations along the length of transfer device 110. Alternately, stitches 130 may be formed to extend across the width of transfer device 110.

Where a charge coupling is use, the charge coupling may be released by grounding the charge so that the charge is discharged from between the two sheet portions.

Alternately, the coupling may be achieved by an adhesive, which releases when neutralized by another agent, or by a chemical reaction that changes the coefficient of friction. For example, an adhesive may be used that loses its adhesive properties when exposed to oxygen, which may be particularly suitable in combination with the vacuum pressure.

Figure 14:
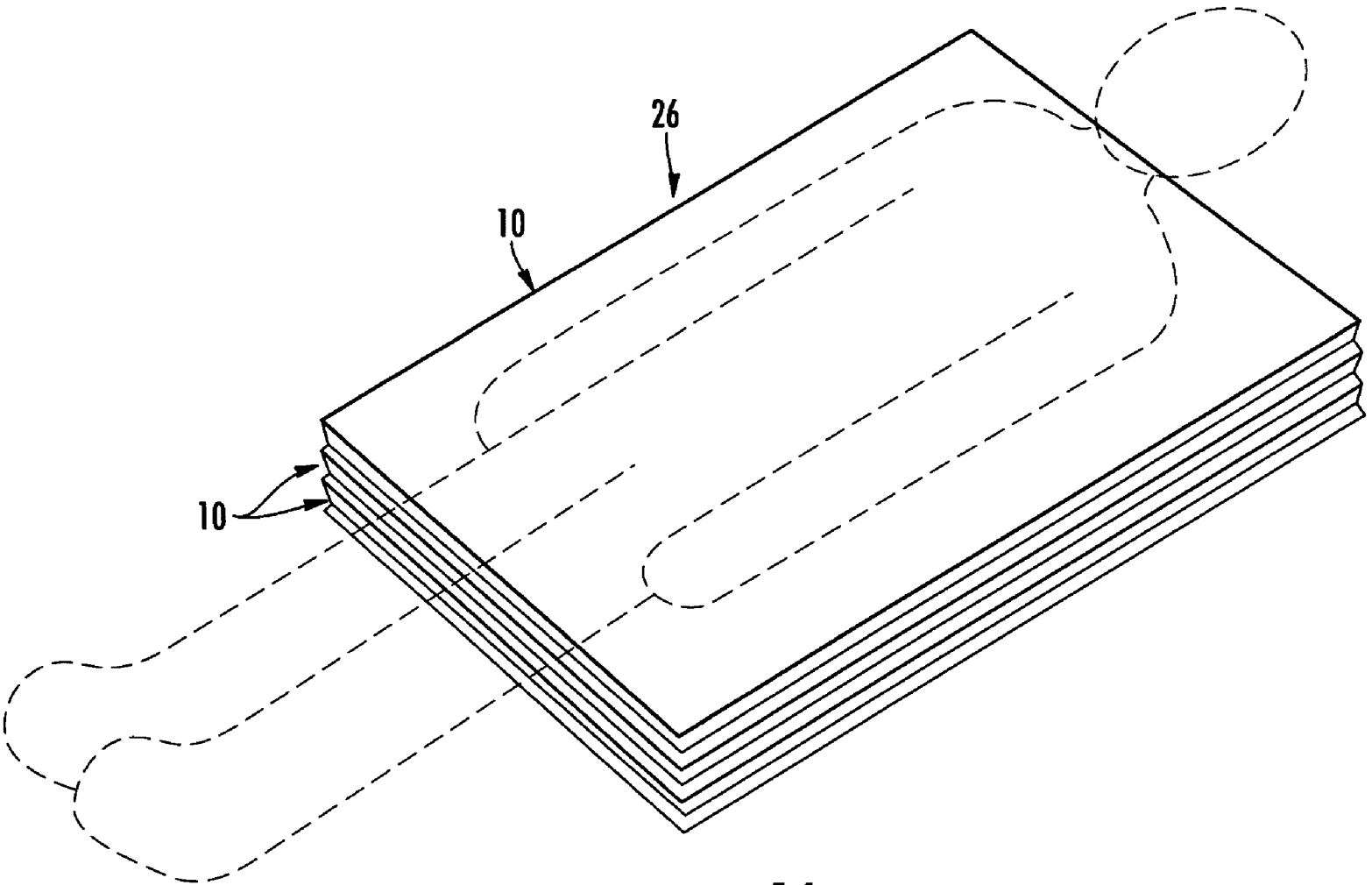
FIG. 14 is a perspective view illustrating a plurality of transfer devices of the present invention positioned in a stacked arrangement wherein the transfer devices may used in a stack, for example, on top of a stretcher or a bed so that each new patient may be provided with a transfer device when initially placed on the stretcher or bed.

Referring to FIG. 14, a transfer device system 26 may be provided that is formed from multiple transfer devices (10 or 110), which are stacked and, further, may be interconnected to form a supply of transfer devices on a surface, such as a stretcher or bed or the like. Transfer devices 10, 110 may be interconnected, for example, at discrete locations by, for example, tabs or a common connector but which are easily released from the common connector or each other, such as by pulling, when a transfer is desired. Optionally, the tab or tabs may be formed from a thin web of plastic that can be stretched to the point of failure with a gentle tug or pull. Alternately, the transfer devices may be attached end to end so that the transfer devices may be rolled and dispensed similar to the sheets that are currently used to cover examination tables, for example.

As noted above, transfer device 10 (110) may be formed as a disposable transfer device that may be used for a single transfer or may be used to transfer a patient multiple times throughout the patient's stay in the facility.

The device may incorporate identification devices, such as RFID or barcodes so that the transfer devices may be tracked, for example, for inventory purposes.

Figure 8:
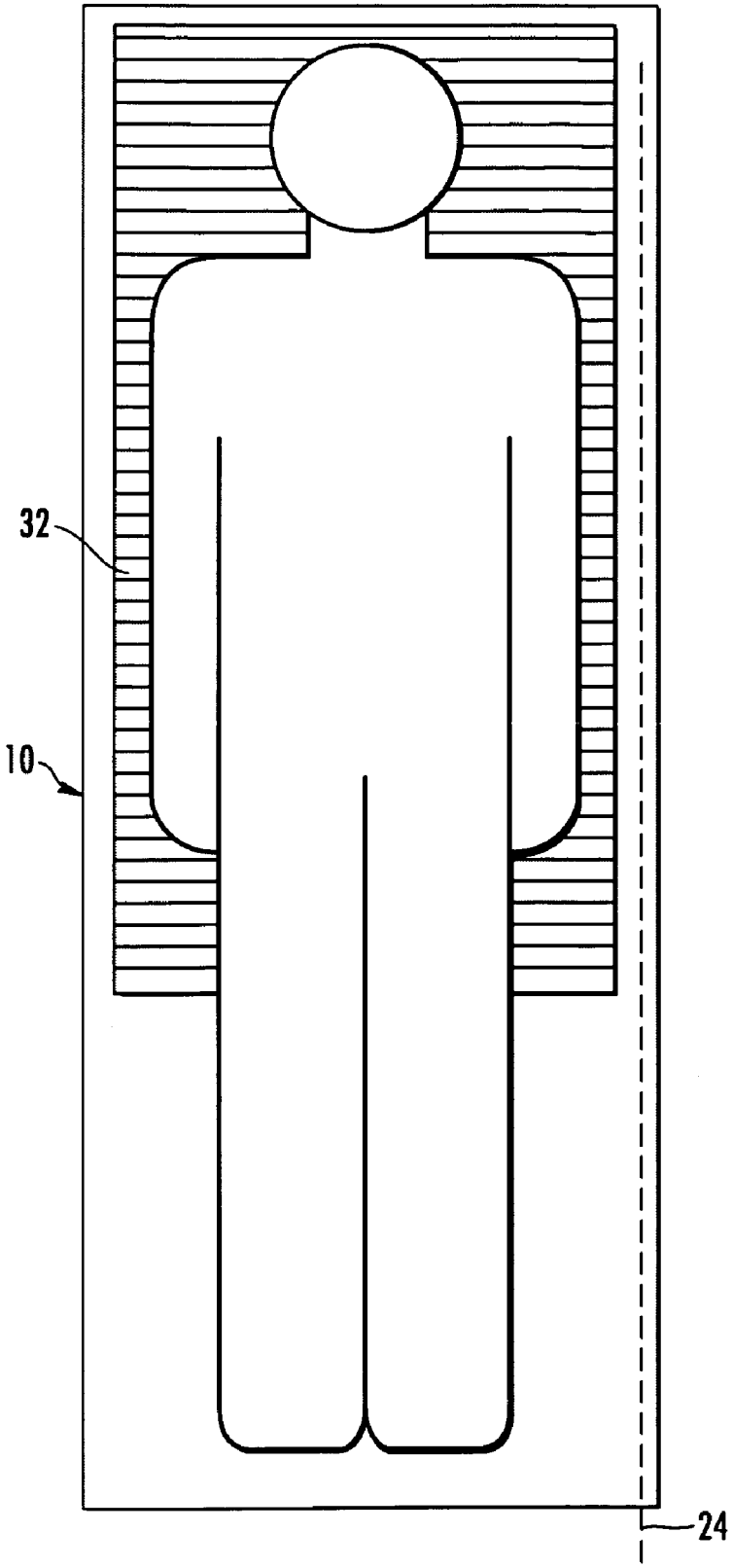
FIG. 8 is a plan view of a patient positioned on a transfer device of the present invention incorporating a pad.

Optionally, transfer device 10 (110) may be used in conjunction with another surface. For example, transfer device 10 (110) may be used in conjunction with a sheet, such as a transfer sheet, an absorbent sheet or material that encloses the device or partially covers the device, or padding. Further, the other surface may provide heating or cooling. Referring to FIG. 8, transfer device 10 (110) may incorporate a pad 32, such as an absorbent pad.

Accordingly, the present invention provides a transfer device that can be used to move or transfer an object or person when movement or a transfer is desired, but which is adapted to limit or minimize the movement when no movement or transfer is desired. Additionally, the transfer device may be used alone or in combination with a transfer sheet that is placed over the device and with the patient placed on the sheet. As noted, the transfer device may be used to move a patient on a surface or to transfer the patient from one surface, such as a stretcher, a cot, a bed, a table, or the like, to another surface, such as a bed, a cot, a stretcher, a table, or the like.

While several forms of the invention have been shown and described, other forms will now be apparent to those skilled in the art. Further, as noted, while the transfer device has been described primarily in reference to a patient, the transfer device may be used to move or transfer a variety of objects. Therefore, it will be understood that the embodiments shown in the drawings and described above are merely for illustrative purposes only, and are not intended to limit the scope of the invention which is defined by the claims that follow, as interpreted under the principles of patent law including the doctrine of equivalents.

We claim:

1. A patient transfer device comprising:

a first sheet portion having an outer side and an inner side;

a second sheet portion having an outer side and an inner side, and said inner side of said second sheet portion facing and forming a chamber with said inner side of said first sheet portion;

and said chamber being sealed and evacuated of air wherein said inner side of said first sheet portion is releasably directly or indirectly coupled to said inner side of said second sheet portion wherein said coupling limits translational movement of said first sheet portion relative to said second sheet portion, and when said chamber is opened said coupling is released and said first sheet portion is slidable relative to said second sheet portion wherein a patient supported on said first sheet portion may be transferred across a surface on which said second sheet portion is supported.

2. The patient transfer device according to claim 1, said chamber having a medium provided therein, said medium releasably coupling, either directly or indirectly, said first sheet portion to said second sheet portion.

3. The patient support device according to claim 2, wherein said medium comprises a vacuum pressure frictionally coupling said first sheet portion to said second sheet portion to limit translational movement of said first sheet portion relative to said second sheet portion, and when said vacuum pressure is released said first sheet portion is translatable relative to said second sheet portion.

4. The patient transfer device according to claim 3, wherein said vacuum pressure directly frictionally couples said inner side of said first sheet portion to said inner side of said second sheet portion.

5. The patient transfer device according to claim 3, further comprising an intermediate member, wherein said vacuum pressure indirectly frictionally couples said first sheet portion to said second sheet portion through said intermediate member.

6. The patient transfer device according to claim 3, wherein said patient transfer device is adapted to form a plurality of channels in said chamber, said channels extending across at least a portion of said chamber to facilitate the distribution of the vacuum pressure through said chamber.

7. The patient transfer device according to claim 6, wherein one of said inner sides includes a plurality of ridges to thereby form said channels.

8. The patient transfer device according to claim 6, further comprising a third sheet portion positioned in said chamber, said third sheet portion having a plurality of ridges or passageways formed therein to form said channels.

9. The patient transfer device according to claim 3, further comprising a vacuum release device for releasing said vacuum pressure.

10. The patient transfer device according to claim 9, wherein said vacuum release device comprises a tab, when pulled said tab creating an aperture in said first sheet portion or second sheet portion.

11. The patient transfer device according to claim 1, wherein said first sheet portion and said second sheet portion are formed from a single sheet.

12. The patient transfer device according to claim 1, wherein at least one of said inner sides has a low coefficient of friction surface.

13. The patient transfer device according to claim 12, wherein said low coefficient of friction surface comprises a lubricious polymer surface.

14. The patient transfer device according to claim 1, wherein each of said outer sides of said first sheet portion and said second sheet portion includes a surface with a higher coefficient of friction than at least one of said inner sides.

15. The patient transfer device according to claim 14, wherein each of said outer sides includes a rubber surface or a surface with a rubber characteristic to thereby form said surfaces with higher coefficients of friction.

16. The patient handling device according to claim 1, wherein at least one of said first sheet portion and said second sheet portion comprises a saran polyvinylidene chloride.

17. The patient handling device according to claim 1, wherein at least one of said first sheet portion and said second sheet portion comprises a polyethylene material.

18. The patient transfer device according to claim 1, wherein said patient transfer device comprises a first patient transfer device, and said first patient transfer device being in combination with a second patient transfer device, and said second patient transfer device being coupled to said first patient transfer device.

19. The patient transfer device according to claim 1, further comprising a handle coupled to said first sheet portion or said second sheet portion.

20. The patient transfer device according to claim 1, further comprising an intermediate member disposed between said first sheet portion and said second sheet portion, said intermediate member releasably coupling said first sheet portion to said second sheet portion.

21. A patient transfer device comprising:

a first sheet portion having an outer side and an inner side;

a second sheet portion having an outer side and an inner side, said inner side of said second sheet portion facing and forming a chamber with said inner side of said first sheet portion and either (a) contacting said inner side of said first sheet portion or (b) bearing on said inner side of said first sheet portion through an intermediate member; and said chamber being sealed and evacuated of air wherein said inner side of said first sheet portion is frictionally coupled, directly or indirectly, to said inner side of said second sheet portion wherein said frictional coupling limits translational movement of said first sheet portion relative to said second sheet portion, and when said chamber is opened said frictional coupling is reduced and said inner surface of said first sheet portion either remains (a) in contact with said inner surface of said second sheet portion or (b) bearing on said inner surface of said first sheet portion through an intermediate member but is slidable relative to said second sheet portion wherein a patient supported on said first sheet portion may be transferred across a surface on which said second sheet friction is supported.

22. The patient transfer device according to claim 21, wherein said inner side of one of said first sheet portion and said second sheet portion comprises a low friction surface.

23. The patient transfer device according to claim 21, further comprising a medium provided between said first sheet portion and said second sheet portion, said medium providing said frictional coupling.

24. The patient transfer device according to claim 23, wherein said medium comprises a vacuum pressure.

25. The patient transfer device according to claim 21 further comprising an intermediate member positioned between said first sheet portion and said second sheet portion, said intermediate member coupling said first sheet portion to said second sheet portion.

26. The patient transfer device according to claim 21, wherein at least one of said first sheet portion and said second sheet portion comprises a material selected from the group consisting of a polyethylene, a saran polyvinylidene chloride, and an anti-static or static dissipative material.

27. The patient transfer device according to claim 21, wherein said first sheet portion and said second sheet portion are formed from a single sheet.

28. The patient transfer device according to claim 27 wherein said sheet forms a closed loop.

29. A patient transfer device comprising:

a closed loop of flexible material having an upper portion and a lower portion, each portion have an outer surface and an inner surface, and said closed loop having opposed ends;

each of said outer surfaces comprising a high coefficient of friction surface;

said opposed ends of said closed loop being closed to thereby form a closed chamber between said ends and said upper and lower portions; and said closed chamber being sealed and being evacuated but being adapted to open, wherein when said chamber is evacuated a normal force is generated between said upper and lower portions such that said upper and lower portions are frictionally coupled, either directly or indirectly, to thereby limit translational movement of said upper portion relative to said lower portion, and when said chamber is opened and said coupling is released and a shear force is applied to said upper portion, said upper portion and said lower portion slide relative to each other such that a patient supported on said upper surface can be transferred across a surface on which said lower portion is supported.

30. The patient transfer device according to claim 29, wherein said patient transfer device is adapted to form a plurality of channels extending through at least a portion of said chamber.

31. The patient transfer device according to claim 30, wherein one of said inner surfaces includes a plurality of ridges or passageways to thereby form said channels.

32. The patient transfer device according to claim 29, wherein at least one of said inner surfaces comprises a low friction surface.

33. The patient transfer device according to claim 29, further comprising a vacuum release device for selectively releasing said vacuum pressure.

34. A patient transfer system comprising:

first and second patient transfer devices coupled together, each of said patient transfer devices comprising:

a first sheet portion having an inwardly facing surface and an outer perimeter, a second sheet portion having an inwardly facing surface and an outer perimeter;

said inwardly facing surface of said first sheet portion and said inwardly facing surface of said second sheet portion forming a chamber, said chamber being evacuated to releasably couple together said inwardly facing surfaces inwardly of said outer perimeters to thereby limit relative translational movement of said first sheet portion to said second sheet portion, and when said coupling is released, said first sheet portion sheet portion and said second sheet portion are slidable relative to each other wherein a patient supported on said first sheet portion may be transferred across a surface on which said second sheet portion is supported.

35. The patient transfer device according to claim 34, wherein said first and second patient transfer devices are coupled together by at least one tab.

36. The patient transfer device according to claim 34, wherein each of said first and second patient transfer devices includes a handle.

37. The patient transfer device according to claim 34, wherein each of said first sheet portion and said second sheet portion includes an outer side, at least one of said outer sides comprising a high coefficient of friction surface.

38. The patient transfer device according to claim 34, wherein said coupling comprises a frictional coupling.

39. The patient transfer system according to claim 38, said chamber being adapted to form a vacuum pressure, and said vacuum pressure generating said frictional coupling between said first sheet portion and said second sheet portion.

40. The patient transfer system according to claim 39, wherein each of said patient transfer devices includes a vacuum pressure release device.

* * * * *

UNITED STATES PATENT AND TRADEMARK OFFICE

CERTIFICATE OF CORRECTION

PATENT NO. : 7,650,654 B2
APPLICATION NO. : 11/714039
DATED : January 26, 2010
INVENTOR(S) : Lambarth et al.

It is certified that error appears in the above-identified patent and that said Letters Patent is hereby corrected as shown below:

Column 2
Line 38, " Möobius" should be -- Möbius--

Column 12
Line 43, Claim 21, "friction" should be --portion--

Column 13
Line 3, Claim 29, "have" should be --having--

Column 14
Line 5, Claim 34, "perimeter," should be --perimeter;--;
Line 15, Claim 34, delete duplicate "sheet portion" after "sheet portion"

Signed and Sealed this

Nineteenth Day of October, 2010

David J. Kappos

David J. Kappos
*Director of the United States Patent and Trademark Office*